US005864925A

United States Patent [19]

McGee

[11] Patent Number: 5,864,925

[45] Date of Patent: Feb. 2, 1999

[54] GOLF GLOVE ATTACHMENT DEVICE

[76] Inventor: Robert Wayne McGee, 16629 Jetton Rd., Cornelius, N.C. 28031

[21] Appl. No.: 962,481

[22] Filed: Oct. 31, 1997

[51] Int. Cl.[6] ..... A44B 18/00; A45F 5/00; A63B 55/00

[52] U.S. Cl. ..... 24/3.11; 24/3.6; 24/3.13; 24/306; 24/905

[58] Field of Search ..... 24/3.11, 3.12, 24/3.13, 3.6, 265 H, 905, 13, 304, 306, 442; 206/315.3; 34/239

[56] References Cited

U.S. PATENT DOCUMENTS

| | | | |
|---|---|---|---|
| D. 349,810 | 8/1994 | Rutledge . | |
| 437,550 | 9/1890 | Armentrout | 24/3.13 |
| 603,538 | 5/1898 | Pettibone | 24/3.13 |
| 1,158,251 | 10/1915 | McDougall | 24/3.6 |
| 1,198,105 | 9/1916 | Butler | 24/3.13 |
| 1,327,534 | 1/1920 | Eichstedt | 24/3.6 |
| 1,718,433 | 6/1929 | Rivas | 24/3.6 |
| 2,307,808 | 1/1943 | Segal | 24/3.6 |
| 3,638,284 | 2/1972 | Baker | 24/306 |
| 4,403,366 | 9/1983 | Lucke . | |
| 4,625,862 | 12/1986 | Clayton . | |
| 5,069,050 | 12/1991 | Chen | 24/3.6 |
| 5,177,881 | 1/1993 | Moore . | |

*Primary Examiner*—Victor N. Sakran
*Attorney, Agent, or Firm*—Kennedy Covington Lobdell & Hickman, LLP

[57] ABSTRACT

A thin plastic card, with passive and aggressive Velcro patches on the front and back, FIG. 1,3 and FIG. 1,4 respectively, is connected to a spring-loaded reel mechanism FIG. 1,1 which contains a retractable cord FIG. 1,8. Said reel mechanism is attached to the person as evidenced in FIG. 3,1. The plastic card FIG. 1,2, is then extended by pulling on the retractable cord in FIG. 1,8 of the reel mechanism. When fully extended, FIG. 4, and passive and aggressive Velcro on the glove is mated and attached to the corresponding passive and aggressive Velcro on the plastic card. Once secured, the golf glove is returned to its resting position on the hip, FIG. 3,11.

10 Claims, 7 Drawing Sheets

GOLF GLOVE ATTACHMENT DEVICE

BACKGROUND—FIELD OF INVENTION

This invention is designed to secure a golf glove, when in disuse, to the golfer while playing golf. The invention will provide ease of use, easy access to the glove and maintenance for the shape and condition of the glove.

BACKGROUND—DESCRIPTION OF PRIOR ART

When playing golf, golfers frequently remove their golf glove. This presents a problem of where to temporarily place the glove. Typically, the glove is stuffed into the pant's pocket until needed again. This results in the glove becoming crumpled and disfigured. This also does not facilitate the drying of the glove as most often the glove is wet from perspiration. Also, if the glove is placed in a location other than with the person, the accessibility to the glove and the ease of retrieval of the glove is made significantly more difficult to manage. Heretofore many different arrangements were used to alleviate these impediments. The following is a discussion of these arrangements and their drawbacks to the access to and care of a golf glove.

One type of arrangement involves placing the glove into a storage bag. The interior of this bag is comprised of moisture absorption material. This material removes the moisture leaving the glove soft and supple. Rutledge U.S. Pat. No. Des. 349,810 (1994) is exemplary. However, in this arrangement the glove is separated from the golfer's person and is not intended for use while playing a round of golf but for subsequent storage.

Another arrangement, shown in Moore U.S. Pat. No. 5,177,881 (1993) utilizes a strap which hangs from the golf bag. The strap contains a fastener which the glove can be secured to. This arrangement is inconvenient, separating, the golfer from his glove and requiring wasted motion to retrieve it. Additionally, the fastener is a bad design for securing the golf glove, therefore increasing the likelihood of damage to or loss of the glove.

U.S. Pat. No. 4,403,366 to Lucke (1983), utilizes a clip attachment. It grips a towel with a projecting hooking element. This element is unsuitable for securing a glove but can be mounted on the belt or pants of the user. However, it does emphasize attachment to the person rather than the golf bag. This is an improvement over previous attempts to affix an accessory to an inanimate bag.

U.S. Pat. No. 4,625,862 to Clayton (1986), provides an assembly to attach a golf club head cover and other accessories to Velcro. A drawing is provided in the patent application that shows a golf glove attached to a component of the assembly which is then attached to the golf bag. This use of the component separates the golfer from his glove which is contrary to the object of my invention. This said component also has Velcro on only one side which does not provide for utilization of the two Velcro sections of a golf glove. This significantly lessens the securing of the glove and fails to support the glove's shape. Instead of attachment to the golf bag, the said component could be attached to the belt of the person. If attached to the belt in the front of the person the attached golf glove would create a major distraction while putting or walking. Such positioning of said component would interfere with the swing and is not acceptable. The said component could then be attached to the belt in a position other than in the front of the person. Positioned as such, both hands cannot be used to attach and, most importantly, remove a golf glove. Even when a golf glove is removed from the golfer's hand, the use of both hands is required. The hand that wears the glove does not remain stationary, but is tightened, fisted, swiveled or otherwise moved in order to assist the other hand in effectively detaching the Velcro. Therefore, attempting to remove the glove from the component with only one hand would be very awkward and difficult and most likely cause irreparable damage to the glove.

OBJECTS AND ADVANTAGES

My invention provides several objects and advantages whereby the golfer has fast, easy, continuous and convenient access to his or her golf glove. My invention is designed for attachment to the belt or to the clothing at a position on the hip where an attached glove cannot cause a distraction. It also provides that an attached glove is secure and that the life of the glove is prolonged. Central to the advantage of my invention is a retractable cord that is approximately 24" in length when fully extended. Using only one hand the golfer very quickly pulls the card component, which is connected to the retractable cord, to a comfortable location in the front of his or her self. The golfer easily and quickly attaches the glove to the card component using both hands and guides it back, using only one hand, to its position on the hip. A sandwich effect is created when both Velcro sections of the golf glove are utilized in attachment to Velcro on both sides of the card. This allows the glove to retain its shape and will secure the glove against loss. Also, while being worn, a golf glove will become very moist from perspiration. A moist golf glove is uncomfortable to wear and is a deterrent to the acceptable gripping of a golf club. The above-mentioned sandwich effect and attachment of the device to the belt or clothing will provide maximum exposure to the air for even drying. Because the device is so convenient a glove can be removed from the hand and attached to the device after each swing. This preferred use would greatly reduce moisture and therefore, maintain the quality of the glove for comfortable wear. This preferred use of the device will also prolong the life of the glove which will result in substantial financial savings realized by the golfer. By not having to be stuffed into a pocket, the golf glove will be kept dry, shapely, supple and soft.

SUMMARY

This device consists of a spring-loaded reel mechanism comprised of a plastic casing with either a metal clip on the back thereof for attachment to the belt or waistband, or a pin on the back thereof for attachment to clothing. The plastic casing contains a retractable cord which is approximately 24" in length when fully extended. The retractable cord is attached to a plastic strip with a snap component. The plastic strip is inserted through an opening on a plastic card. The plastic strip is then snapped closed to form a loop for the purpose of connecting the plastic card to the retractable cord. The plastic card can then be extended from its position on the hip to the front of the golfer for attachment or detachment of a glove. The plastic card is the approximate size of a credit card and is comprised of passive Velcro on one side with aggressive Velcro on the opposite side which attach to the corresponding aggressive and passive Velcro sections of a golf glove.

PREFERRED EMBODIMENT—DESCRIPTION

Figure 1:
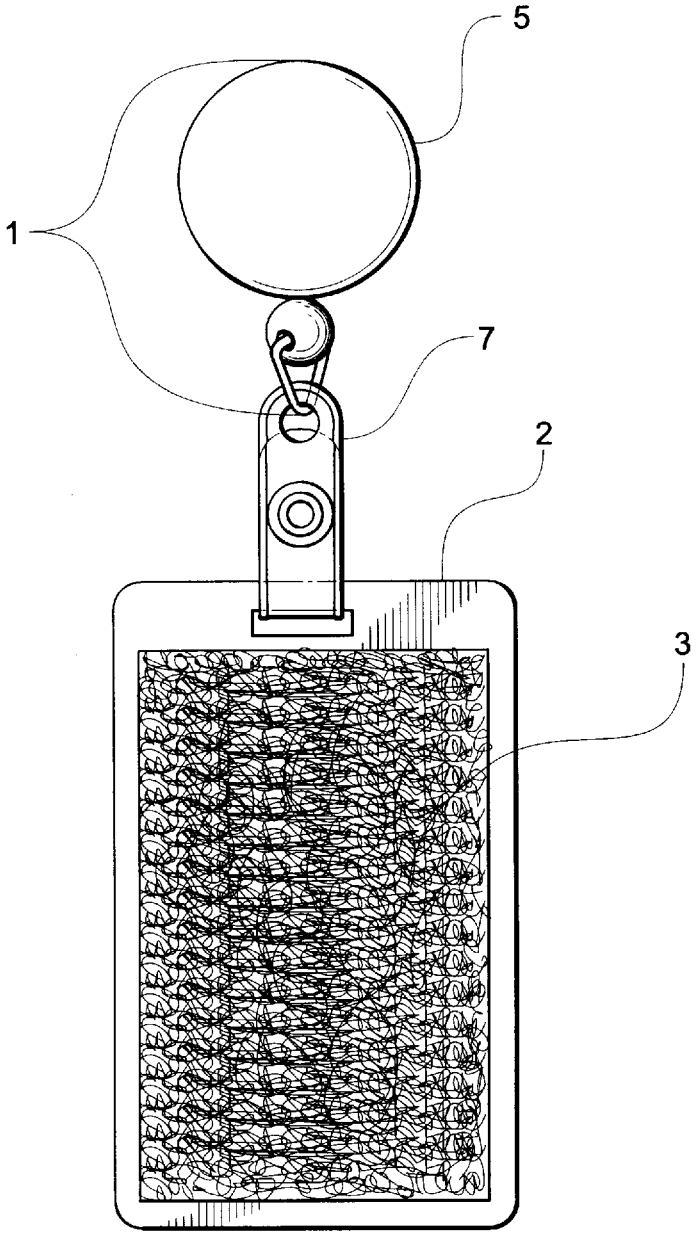
FIG. 1 is a front view of the device.
Figure 2:
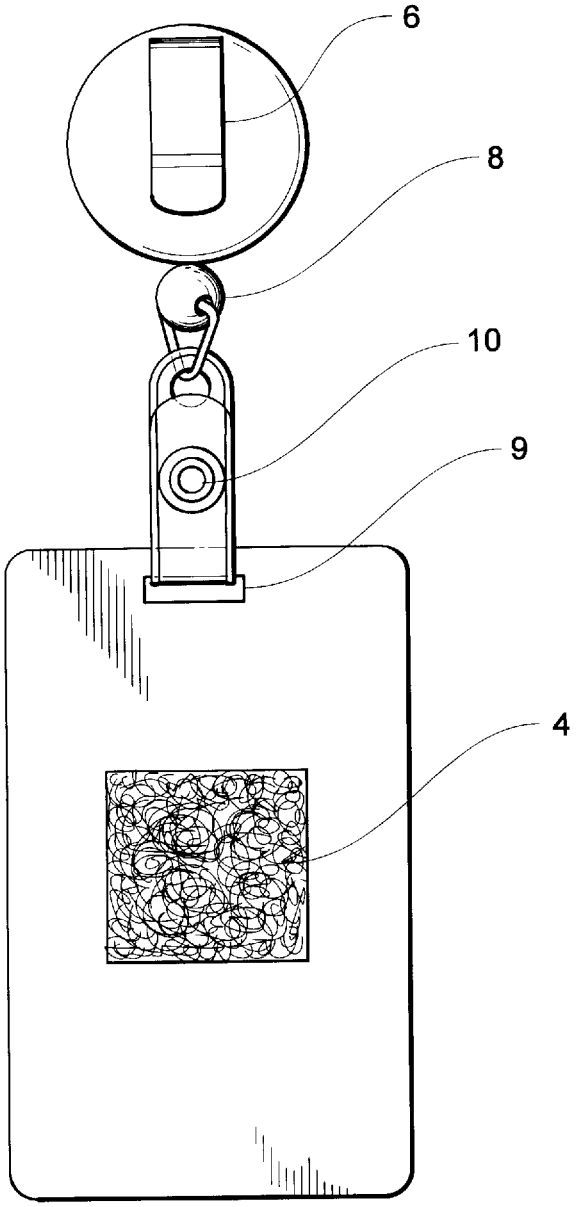
FIG. 2 is a back view of the device.
Figure 3:
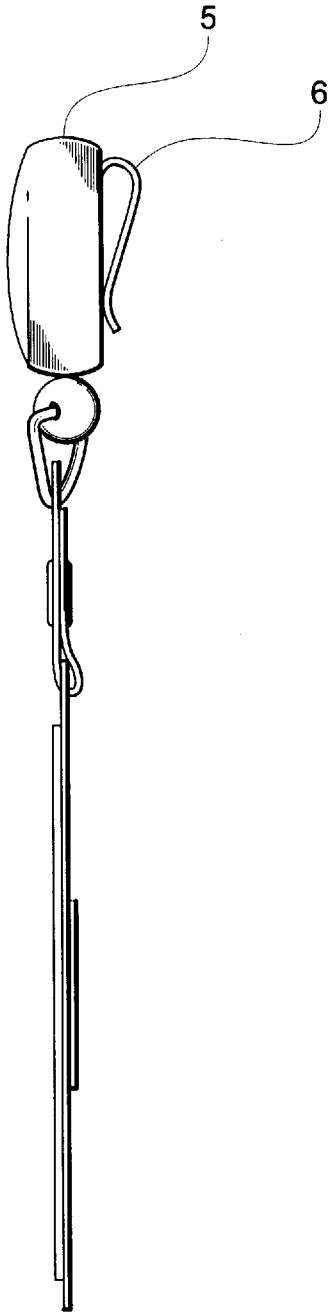
FIG. 3 is a side view of the device.

Operation and use of device is simple and straightforward. In FIGS. 1 and 2 the thin plastic card 2 is shown from the front and from the back, respectively. The front view reveals the large Velcro patch 3 which is adhered to the front of the card. The Velcro patch 3 covers approximately the entire frontal surface. Conversely, the back view reveals a small Velcro patch 4 which is centered on the card. The Velcro patch 3 on the front is a passive receptor and the Velcro patch 4 on the back is aggressive. These two patches, 3 and 4 are adhesion points for the corresponding passive and aggressive and the Velcro patches affixed to a golf glove. FIGS. 1 and 2 also show the spring-loaded reel mechanism 1 comprised of a plastic casing 5 containing a high strength cord with a plastic swivel head 8. The cord is attached to the reel mechanism and is extended when pulled and retracted when released. This spring-loaded reel mechanism is produced for a variety of uses, including the attachment of keys and for readable plastic cards with metallic strips which are scanned by magnetic card readers. The back view in FIG. 2 also shows the metal clip attachment 6 which attaches the device to the person's belt or pants waistband. Alternatively, a pin attachment could be used for pinning the device to clothing. The card 2 and the reel mechanism 1 are connected by a plastic strip 7 with a snap component 10. The strip 7, which is attached to the swivel head of the retractable cord 8, is inserted through an opening 9 in the card 2 and snapped closed 10 to form a connecting loop.

Figure 4:
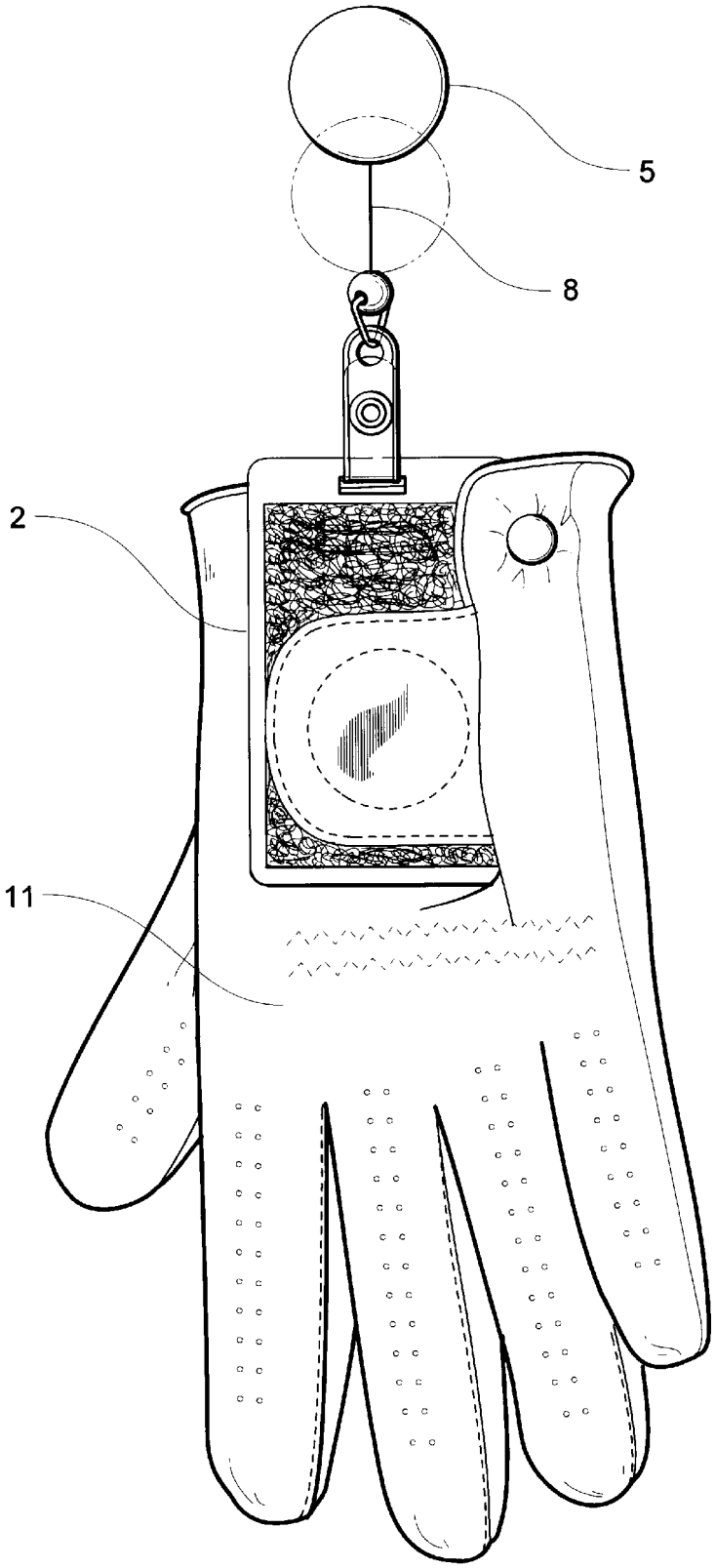
FIG. 4 is a front view of the golf glove attached to the device.

FIG. 4 demonstrates the sandwiching effect of the passive and aggressive Velcro sections of a glove 11 to the corresponding aggressive and passive Velcro patches on the plastic card 2. Also shown is a partial extension of the retractable cord 8. It can be seen that the glove is allowed to retain its shape which will allow for even drying.

Figure 5:
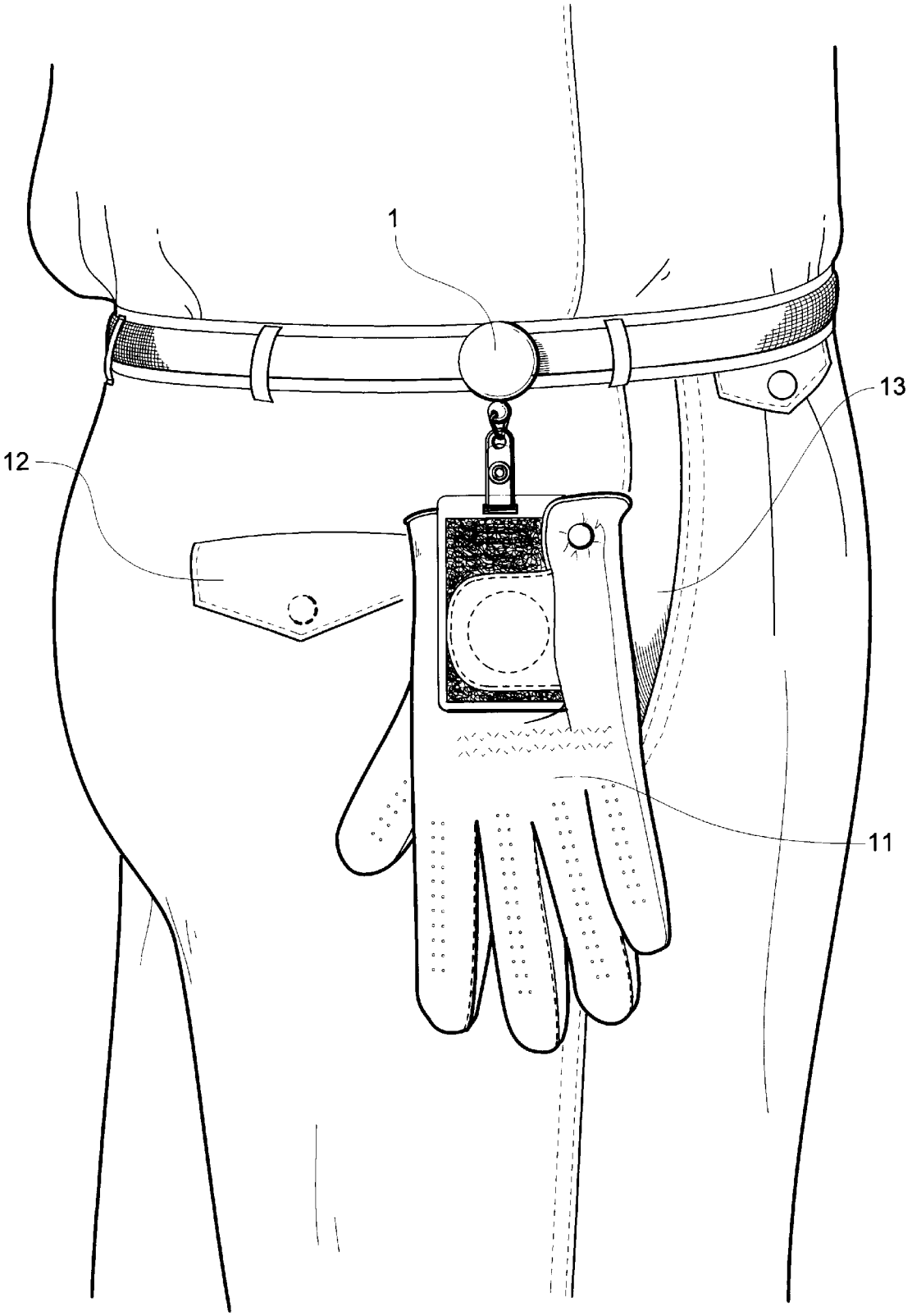
FIG. 5 is a perspective view of the position of the device on the golfer's hip.

FIG. 5 demonstrates the positioning of the device 1 on the belt. The device, shown with an attached glove 11, is secured on the golfer's hip, approximately halfway between the back pocket 12 and the front pocket 13. It can be observed that in this position the device will not interfere with the swing. An attached glove will not be visible to the golfer and therefore, will not create a distraction when putting or when walking. It can also be observed that the attached glove will not be sat upon while in the cart, but will rest at the golfer's side.

Figure 6:
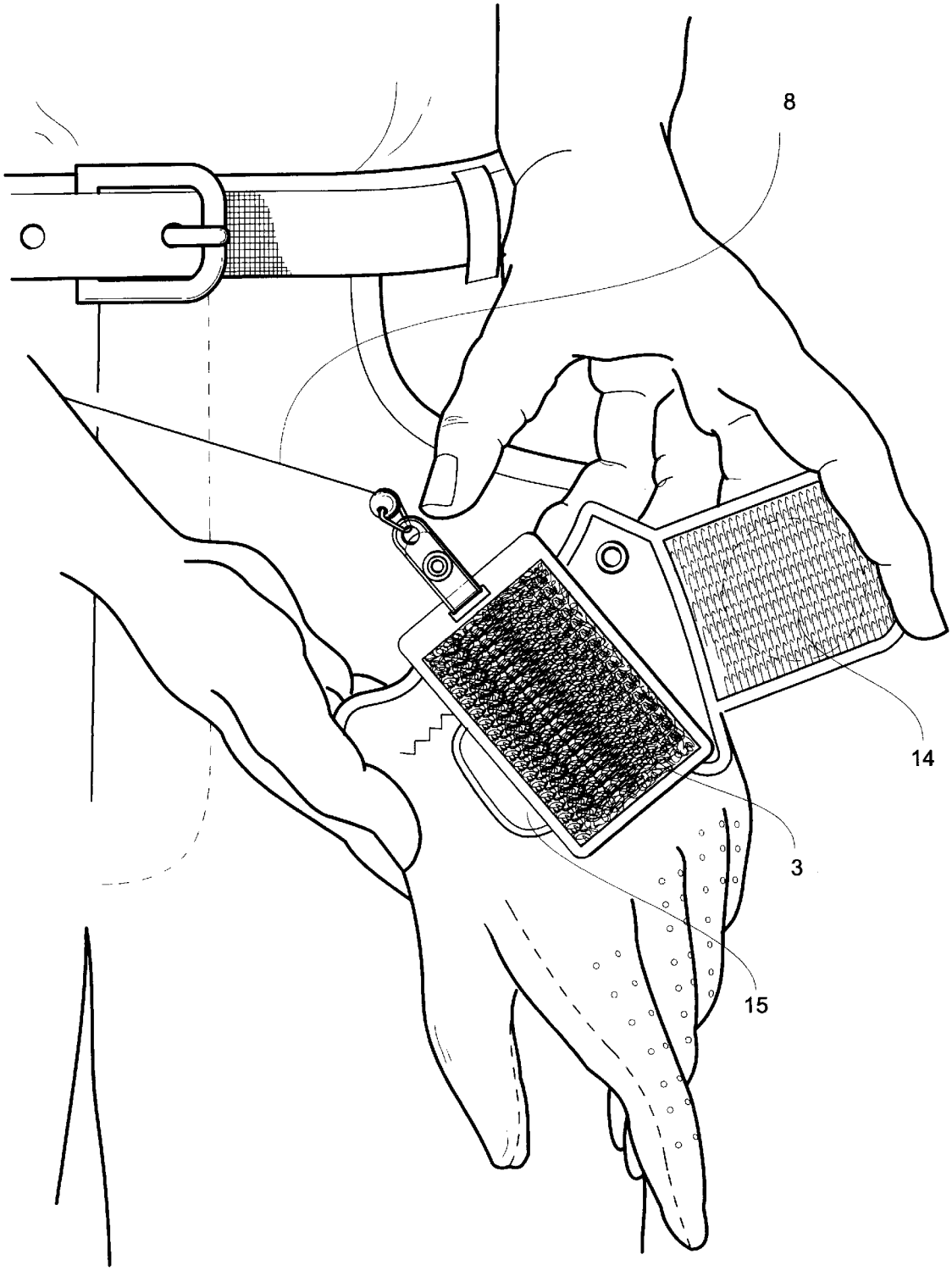
FIG. 6 is a representation of the fully extended retractable cord with the attached card component positioned in a comfortable location for either attachment, or detachment of a golf glove.

It is shown In FIG. 6 that a fully extended retractable cord 8 delivers the card to the front of the golfer for easy attachment to the glove. Both hand can conveniently sandwich the passive Velcro side 3 of the card to the aggressive Velcro section 14 of the glove and the corresponding aggressive Velcro side (bottom side) of the card to the passive Velcro section 15 of the glove.

Figure 7:
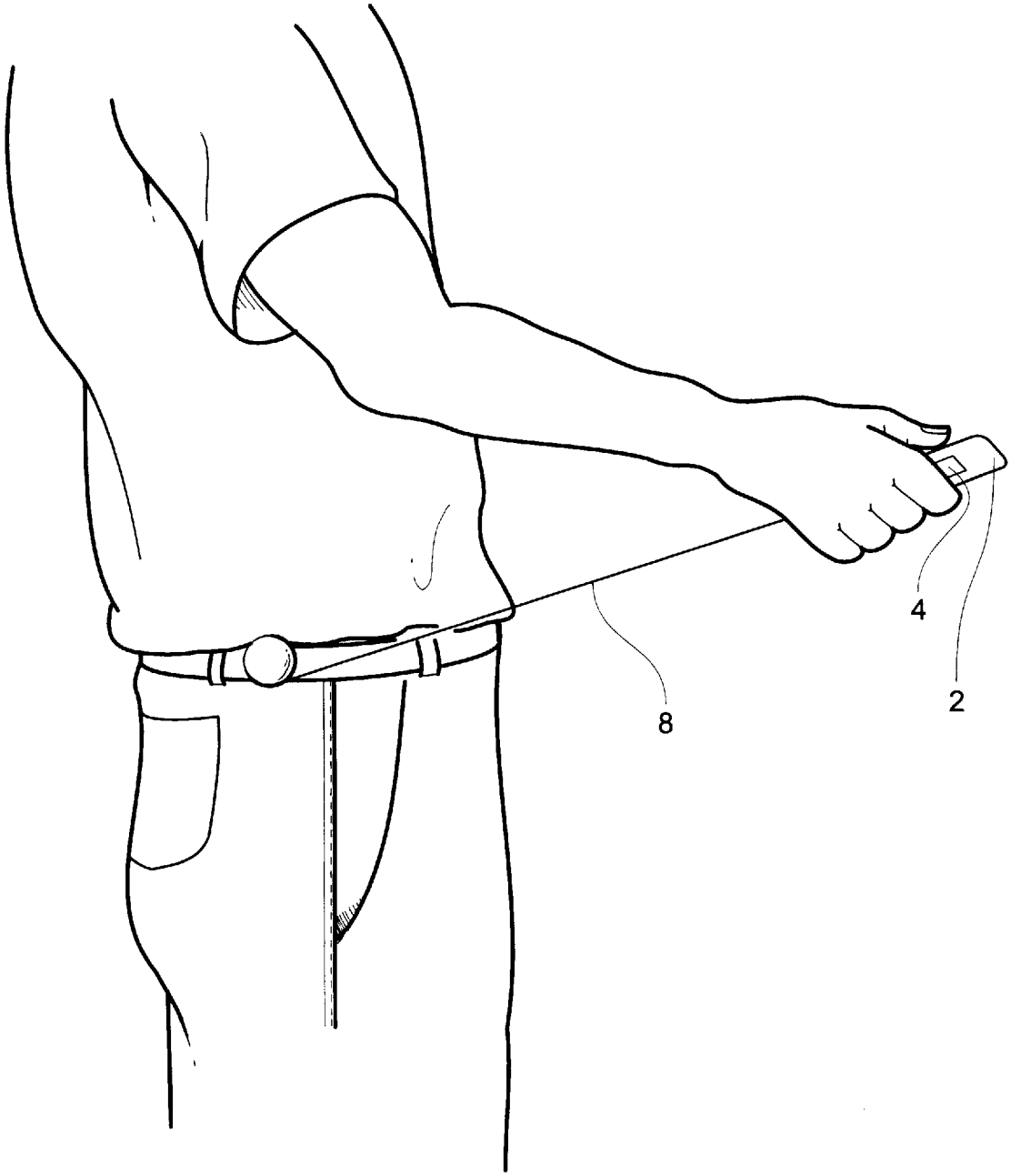
FIG. 7 is a side view of the fully extended retractable cord.

FIG. 7 demonstrates the full extension of the retractable cord 8. It can be seen that the retractable cord is a most unique component of the device. It allows for the device to be positioned so as not to interfere with the golfer's play while at the same time allowing for easy access to the card 2 for attachment of a glove.

CONCLUSIONS, RAMIFICATIONS AND SCOPE

It can be seen that the card is securely sandwiched between the passive an aggressive Velcro sections of a golf glove. Said Velcro sections are attached to the corresponding Velcro sections on the card. The card is attached to the retractable cord contained in the plastic casing of the spring-loaded reel mechanism by a simple plastic strip that is snapped closed to form a connecting loop. A metal clip or alternate pin is attached to the back of the plastic casing of said reel mechanism and is used to attach the reel mechanism to the person's belt, pants waistband or clothing. The device is positioned on the hip so as not to interfere with the golfer's play. The card is conveniently accessed by grasping the card and extending the retractable cord. After the glove is attached to the cord is allowed to retract into the plastic casing. The glove is now steadfastly secured, very neatly shaped and conveniently positioned.

Although the description above contains many specificities, these should not be construed as limiting the scope of the invention but as merely providing illustrations of some of the presently preferred embodiments of this invention. Various other embodiments and ramifications are possible within it's scope.

Thus the scope of the invention should be determined by the appended claims and their legal equivalents, rather than by the examples given.

What is claimed is:

1. A device for temporary attachment of a golf glove when not in use, wherein the golf glove is of the type comprising a hook-and-loop closure having a first male closure section and a first female closure section selectively matable with and separable from the first male closure section for closing and opening the closure, the device comprising:

A) a card having opposed outwardly facing side surfaces,

B) a second male hook-and-loop closure section affixed to one side surface of the card for mating engagement with the first female closure section of the golf glove, C) a second female hook-and-loop closure section affixed to the opposite side surface of the card for mating engagement with the first male closure section of the golf glove, and D) means for attaching the card to a support for selective extension and retraction of the card relative to the support, wherein the golf glove may be securely attached to the card by engagement of the first male closure section of the glove with the second female closure section on the card and simultaneous engagement of the first female closure section of the glove with the second male closure section on the card to sandwich the card between the closure sections of the glove, thereby supporting the glove essentially without deformation.

2. A device according to claim 1, wherein the attaching means comprises a spring-loaded reel mechanism having a reel body attachable to the support and a cord selectively extensible from and retractable into the reel body.

3. A device according to claim 2, wherein the reel mechanism comprises a clip for attachment at a waistband of a user's pants.

4. A device according to claim 2, wherein the reel mechanism comprises a pin for attachment to a user's clothing.

5. A device according to claim 2, and further comprising swivel means for attaching the card to the cord.

6. A device according to claim 1, wherein the second male closure section and the second female closure section are of differing sizes.

7. A device according to claim 6, wherein the second female closure section covers substantially the entirety of the opposite side surface of the card.

8. A device for temporary attachment of a golf glove when not in use, wherein the golf glove is of the type comprising a hook-and-loop closure having a first male closure section and a first female closure section selectively matable with and separable from the first male closure section for closing and opening the closure, the device comprising:

A) a card having opposed outwardly facing side surfaces,

B) a second male hook-and-loop closure section affixed to one side surface of the card for mating engagement with the first female closure section of the golf glove, C) a second female hook-and-loop closure section affixed to the opposite side surface of the card to substantially cover the entirety thereof for mating engagement with the first male closure section of the golf glove, and D) means for attaching the card to a support for selective extension and retraction of the card relative to the support, the attaching means comprising a spring-loaded reel mechanism having a reel body, a cord selectively extensible from and retractable into the reel body, an attachment element for attaching the reel body to a user's clothing, and swivel means for attaching the card to the cord, wherein the golf glove may be securely attached to the card by engagement of the first male closure section of the glove with the second female closure section on the card and simultaneous engagement of the first female closure section of the glove with the second male closure section on the card to sandwich the card between the closure sections of the glove, thereby supporting the glove essentially without deformation.

9. A device according to claim 8, wherein the attachment element comprises a clip for attachment at a waistband of a user's pants.

10. A device according to claim 8, wherein the attachment element comprises a pin for attachment to a user's clothing.

* * * * *